United States Patent [19]

Higuchi et al.

[11] Patent Number: 4,850,810

[45] Date of Patent: Jul. 25, 1989

[54] SLANT PLATE TYPE COMPRESSOR WITH VARIABLE DISPLACEMENT MECHANISM

[75] Inventors: Teruo Higuchi, Isesaki; Kazuhiko Takai, Maebashi, both of Japan

[73] Assignee: Sanden Corporation, Gunma, Japan

[21] Appl. No.: 96,038

[22] Filed: Sep. 15, 1987

[30] Foreign Application Priority Data

Sep. 16, 1986 [JP] Japan ..... 217622

[51] Int. Cl.[4] ..... F04B 1/28

[52] U.S. Cl. ..... 417/222; 417/270

[58] Field of Search ..... 417/222 S, 270; 62/217

[56] References Cited

U.S. PATENT DOCUMENTS

| | | | |
|---|---|---|---|
| 2,573,863 | 11/1951 | Mitchell . | |
| 2,964,234 | 12/1960 | Loomis . | |
| 3,810,488 | 5/1974 | Orth | 62/217 |
| 3,861,829 | 1/1975 | Roberts et al. . | |
| 4,037,993 | 7/1977 | Roberts . | |
| 4,073,603 | 2/1978 | Abendschein et al. . | |
| 4,145,163 | 3/1979 | Fogelberg et al. . | |
| 4,174,191 | 11/1979 | Roberts . | |
| 4,428,718 | 1/1984 | Skinner . | |
| 4,475,871 | 10/1984 | Roberts . | |
| 4,480,964 | 11/1984 | Skinner . | |
| 4,492,527 | 1/1985 | Swain | 417/270 |
| 4,526,516 | 7/1985 | Swain et al. . | |
| 4,543,043 | 4/1985 | Roberts | 417/222 S |
| 4,586,874 | 5/1986 | Hiraga | 417/222 S |
| 4,606,705 | 8/1986 | Parekh . | |
| 4,664,604 | 5/1987 | Terauchi | 417/222 S |
| 4,687,419 | 8/1987 | Suzuki | 417/270 |
| 4,688,997 | 8/1987 | Suzuki et al. . | |
| 4,702,677 | 10/1987 | Takenaka et al. . | |

FOREIGN PATENT DOCUMENTS

| | | | |
|---|---|---|---|
| 176798 | 3/1986 | Japan | 417/222 S |
| 2153922 | 1/1985 | United Kingdom . | |

*Primary Examiner*—William L. Freeh

*Attorney, Agent, or Firm*—Banner, Birch, McKie & Beckett

[57] ABSTRACT

A slant plate type compressor, such as a wobble plate type compressor, with a variable displacement mechanism is disclosed. The compressor has a valve mechanism to control the opening and closing of a passageway connected between the crank chamber and suction chamber. The valve mechanism operates in accordance with the pressures in the crank chamber and the suction chamber of the compressor. Therefore, the compressor has improved cooling characteristics and lubricating oil does not leak out of the compressor into the external refrigeration circuit.

8 Claims, 3 Drawing Sheets

SLANT PLATE TYPE COMPRESSOR WITH VARIABLE DISPLACEMENT MECHANISM

TECHNICAL FIELD

The present invention relates to an improved refrigerant compressor for an automotive air conditioner. More particularly, the present invention relates to a slant plate compressor, such as a wobble plate type compressor, with a variable displacement mechanism suitable for use in an automotive air conditioning system.

BACKGROUND OF THE INVENTION

One construction of a slant plate type compressor, particularly a wobble plate compressor, with a variale capacity or variable displacement mechanism which is suitable for use in an automotive air conditioner is disclosed in the U.S. Pat. No. 3,861,829 issued to Roberts et al. Roberts et al. '829 disclosed a wobble plate type compressor which has a cam rotor driving device to drive a plurality of pistons. The slant or incline angle of the slant surface of the wobble plate is avaried to change the stroke length of the pistons which changes the displacement of the compressor. Changing the incline angle of the wobble plate is effected by changing the pressure difference between the suction chamber and the crank chamber in which the driving device is located.

In such a prior art compressor, the slant angle of the slant surface is controlled by the pressure in the crank chamber. Typically this control occurs in the following manner. The crank chamber communicates with the suction chamber through an aperture and the opening and closing of the aperture is controlled by a valve mechanism. The valve mechanism generally includes a bellows element and a needle valve, and is located in the suction chamber so that the bellows element operates in accordance with changes in the suction chamber pressure.

In the above compressor, the pressure in the suction chamber is compared with a predetermined value by the valve mechanism. Referring to FIG. 3, the pressure is maintained within a small range SR1 in the suction chamber. However, when the predetermined value is below a certain critical value Pa, there is a possiblity of frost forming on the evaporator in the refrigerant circuit. Thus, the predetermined value is usually set at a pressure P1 higher than the critical value to prevent frost from forming on the evaporator. In the graphs, $T_1$ is the time at which the thermal load is increased. Before time$=T_1$, the thermal load is being determined.

However, since suction pressures above this critical value are higher than the pressure in the suction chamber when the compressor operates at maximum capacity, the cooling characteristics of the compressor are inferior to those of the same compressor without a variable displacement mechanism. Furthermore, since the range of the pressure change CR1 in the crank chamber becomes large, lubricating oil contained in the crank chamber may flow into the external refrigeration circuit through the suction chamber and cylinders. This reduces the heat-exchanging ratio of the evaporator.

One solution to resolve these disadvantages is disclosed in our copending patent application Ser. No. 918,065 filed on Oct. 14, 1986. This application disclosed a variable capacity mechanism for a slant plate type compressor which controls the capacity of compressor while uniformly maintaining the pressure in the crank chamber, as shown in FIG. 1. In these compressors, the capacity adjusting mechanism operates to control the capacity of the compressor using a predetermined pressure value of P2 in the suction chamber which is lower than the critical pressure value Pa. Therefore, the cooling characteristics are improved. However, the pressure range in the suction chamber SR2 increases. Therefore, the temperature changes of the air flowing out of the evaporator and into the passenger compartment of automobile also increases.

Roberts et al. '829 discloses a capacity adjusting mechanism used in a wobble plate type compressor. As is typical in this type of compressor, the wobble plate is disposed at a slant or incline angle relative to the drive axis nutates but does not rotate, and drivingly couples the pistons to the drive source. This type of capacity adjusting mechanism, using selective fluid communication between the crank chamber and the suction chamber can be used in any type of compressor which uses a slanted plate or surface in the drive mechanism. For example, U.S. Pat. No. 4,664,604 issued to Terauchi discloses this type of capacity adjusting mechanism in a swash plate type compressor. The swash plate, like the wobble plate, is disposed at a slant angle and drivingly couples the pistons to the drive source. However, while the wobble palte nutates only, the swash plate both nutates and rotates. The term slant plate type compressor will therefore be used to refer to any type of compressor, including wobble and swash plate types, which use a slanted plate or surface in the drive mechanism.

SUMMARY OF THE INVENTION

It is a primary object of this invention to provide a slant plate type compressor with a variable displacement mechanism which can better control the temperature in a passenger compartment of a vehicle.

It is another object of this invention to provide a slant plate type compressor with a variable displacement mechanism which has improved cooling characteristics.

It is another object of the present invention to provide a slant plate type compressor which does not leak oil into the external refrigeration circuit.

A slant plate type compressor for use in a refrigeration circuit in accordance with the present invention includes a compressor housing having a front end plate at one of its ends and a rear end plate at its other end. A crank chamber and a cylinder block are located in the housing, and a plurality of cylinder are formed in the cylinder block. A piston is slidably fitted within each of the cylinders and is reciprocated by a driving mechanism. The driving mechanism includes a drive shaft, a drive rotor coupled to the drive shaft and rotatable therewith, and a coupling mechanism which drivingly couples the rotor to the pistons such that the rotary motion of the rotor is converted to reciprocating motion of the pistons. The coupling mechanism includes a member which has a surface disposed at an incline angle relative to the drive shaft. The incline angle of the member is adjustable to vary the stroke length of the reciprocating pistons and thus vary the capacity of displacement of the compressor. The rear end plate surround a suction chamber and a discharge chamber.

A passageway provides fluid communication between the crank chamber and the suction chamber. A valve mechanism controls the opening and closing of the passageway to vary the capacity of the compressor while adjusting the incline angle of the coupling mechanism. The valve mechanism includes a valve element to directly control the opening and closing of the passageway, a first valve control device to control the movement of the valve element in accordance with the refrigerant pressure in the crank chamber, and a second valve control device to control the movement of the valve element in accordance with the refrigerant pressure in the suction chamber.

Various additional advantages and features of novelty which characterize the invention are further pointed out in the claims that follow. However, for a better understanding of the invention and its advantages, reference should be made to the accompanying drawings and descriptive matter which illustrate and describe the preferred embodiments of the invention.

DETAILED DESCRIPTION OF PREFERRED EMBODIMENTS

Figure 1:
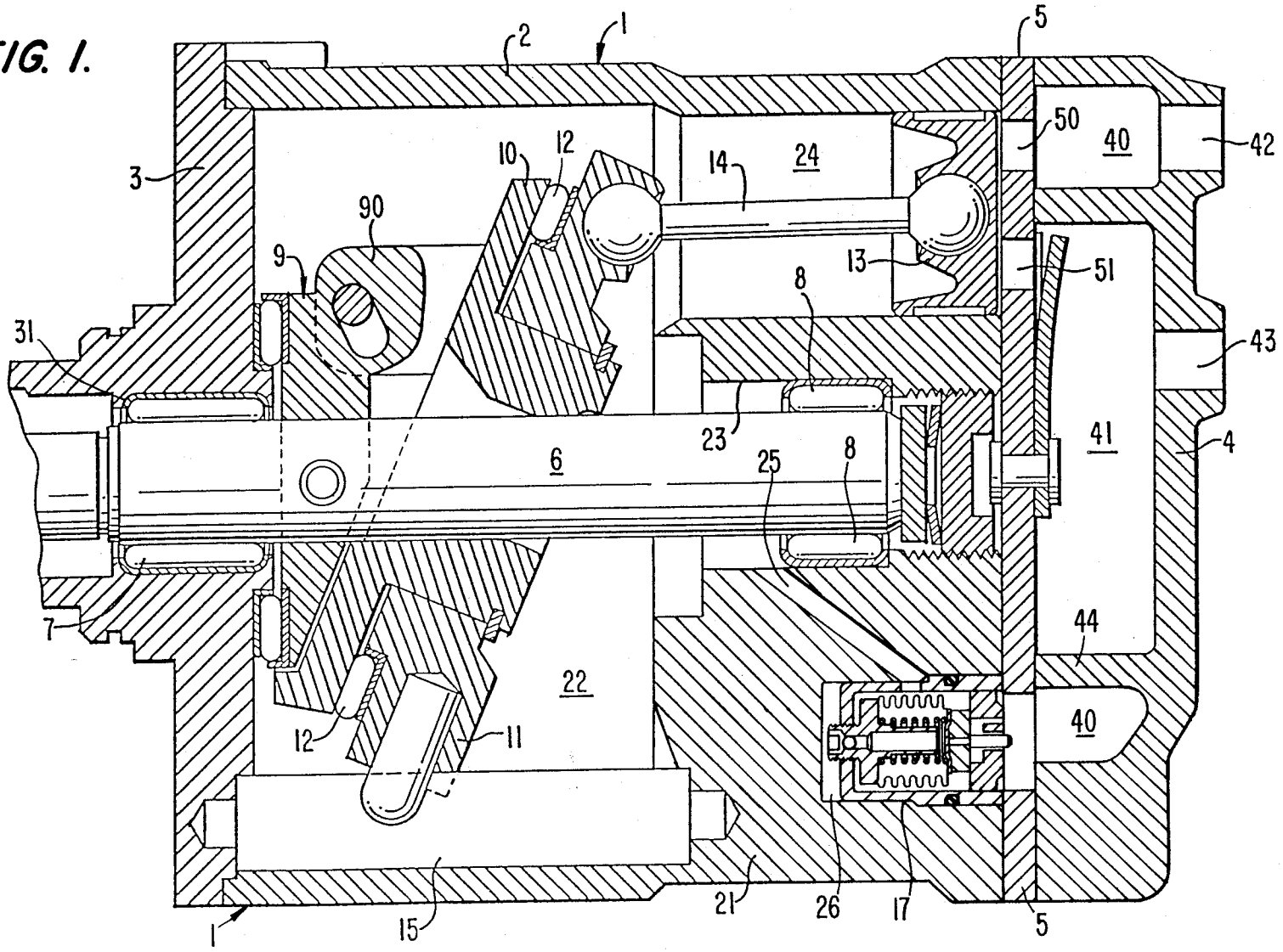
FIG. 1 is a cross-sectional view of a slant plate type compressor in accordance with one embodiment of this invention.

With reference to FIG. 1, the construction of a slant plate type compressor, specifically a wobble plate type compressor, with a variable displacement mechanism according to this invention is shown. Compressor 1 includes a closed housing assembly formed by cylindrical compressor housing 2, front end plate 3, and a rear end plate in the form of cylinder head 4. Cylinder block 21 and crank chamber 22 are located in compressor housing 2. Front end plate 3 is attached to one end surface of compressor housing 2. Cylinder head 4, which is disposed on the other end surface of compressor housing 2, is fixed on one end surface of cylinder block 21 through valve plate 5. Opening 31 is formed in the central portion of front end plate 3 to receive drive shaft 6.

Drive shaft 6 is rotatably supported on front end plate 3 through bearing 7. A shaft seal (not shown) is disposed between the inner surface of opening 31 and the outer surface of drive shaft 6 at the outside of bearing 7. An inner end portion of drive shaft 6 extends into central bore 23 formed in the central portion of cylinder block 21 and is rotatably supported therein by bearing 8. Rotor 9, which is disposed in the interior of crank chamber 22, is connected to drive shaft 6 to be rotatable therewith and engages inclined plate 10 on one side surface through hinge portion 90. The incline angle of inclined plate 10 with respect to drive shaft 6 can be adjusted by hinge portion 90. Wobble plate 11 is disposed on the other side surface of inclined plate 10 and bears against it through bearing 12.

A plurality of cylinders 24, one of which is shown in FIG. 1, are equiangularly formed in cylinder block 21, and piston 13 is slidably disposed within each cylinder 24. Each piston 13 is connected to wobble plate 11 through a coonnecting rod 14. One end of each connecting rod 14 is connected to wobble plate 11 with a ball joint and the other end of each connecting rod 14 is connected to one of pistons 14 with a ball joint. Guide bar 15 extends within crank chamber 22 of compressor housing 2. The lower end portion of wobble plate 11 engages guide bar 15 to enable wobble plate 11 to reciprocate along guide bar 15 while preventing rotating motion.

Pistons 13 are thus reciprocated in cylinders 24 by a drive mechanism formed of drive shaft, 6, rotor 9, inclined plate 10, wobble plate 11 and connecting rods 14. Drive shaft 6 and rotor 9 rotate. Inclined plate 10 nutates and rotates, and wobble plate 11 nutates only. Inclined plate 10, wobble plate 11 and connecting rods 14 function as a coupling mechanism to convert the rotatingn motion of the rotor into reciprocating motion of the pistons.

Cylinder head 4 has an interior space divided into at least two chambers, suction chamber 40 and discharge chamber 41. Suction chamber 40 and discharge chamber 41 are divided by partition wall 44, and both chambers communicate with cylinders 24 through suction holes 50 or discharge holes 51 formed through valve plate 5, respectively. Also, cylinder head 4 is provided with inlet port 42 and outlet port 43 which place suction chamber 40 and dishcarge chamber 41 in fluid communication with an external refrigeration circuit.

Figure 2:
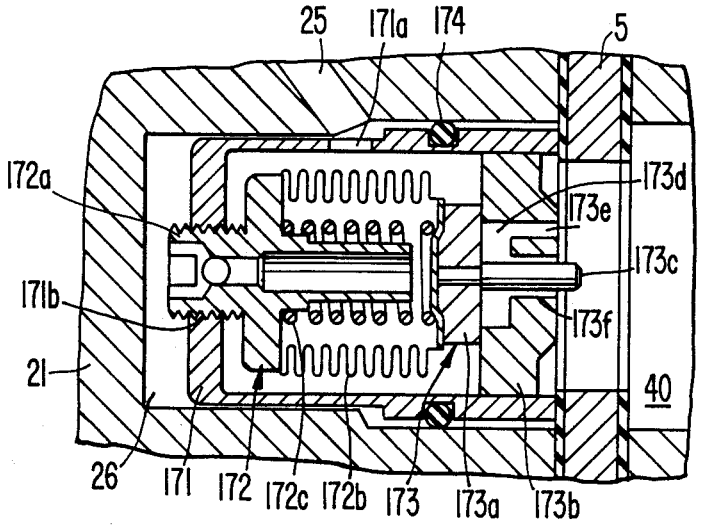
FIG. 2 is an enlarged cross-sectional view of the variable displacement mechanism of the slant plate type compressor shown in FIG. 1.

Passageway 25 is formed in cylinder block 21 to communicate between suction chamber 40 and crank chamber 22 through hollow portion 26 formed in cylinder block 21. Valve control mechanism 17 is located in hollow portion 26. As shown in FIG. 2, mechanism 17 includes a cup-shaped casing 171, bellows 172 which operates as a first pressure sensing portion and is disposed within casing 171, and valve element 173 which opeates as a second pressure sensing portion. Casing 171 is fixedly disposed within hollow portion 26. An O-ring 174 is disposed on the ouer peripheral surface of casing 171 to seal between casing 171 and hollow portion 26 and obstruct communication between passageway 25 and suction chamber 40. Casing 171 is provided with opening **171*a* at its outer peripheral surface to provide communication between passageway 25 and hole 171*b* at the bottom portion of casing 171 through the interior of casing 171. A threaded portion is formed on hole 171*b*. Bellows 172 includes adjusting screw 172*a* which adjusts the operating point of bellows 172. Adjusting screw 172*a* is received in the threaded portion of hole 171*b*. Bellows 172 also includes bellows element 172*b* within which a oil sprng 172*c* is disposed. Coil spring 172*c* determines the bias of bellows element 172*b*. Adjusting screw 172 a is attached to one end portion of bellows element 172*b*. Valve element 173 includes an operating valve 172*a* which is attached to the other end portion of bellows element 172*b*. Valve element 173 also includes valve seat 173*b* which is fixed in the open portion of casing 171. Guide pin 13***c* is attached to the end surface of operating valve 173*a* and guides the axial movement of bellows 172. Depressed portion 173*d* is formed on valve seat 173*d* at the side opposite of suction chamber 40 to define a suction pressure acting area. Hole 173*e* is formed through valve seat 173*b* to communicate between suction chamber 40 and depressed portion 173*d* to pemit introduction of suction gas tinto depressed portion 13*d*. Hole 173*f* is also formed through valve seat 173*b* to receive guide pion 173*c* of operating valve 173*a*.

The reaction force F of bellows 172, which is composed of the reaction force of bellows element 172*b* and the recoil strength of coil spring 172*c* equals the forces due to the suction pressure and the crank chamber pressure and is deterined by the following equation:

$$F=(A_1-A_2)Pc+A_2\,Ps \quad (1)$$

wherein A1 is the effective cross-sectional area of bellows element 172*b*, A2 is the effective cross-sectional area of depressed portion 13*d*, Pc is the pressure in crank chamber 22, and Ps is the pressure in suction chamber 40.

The above equation can be converted into the following equation by solving for Pc:

$$Pc=\frac{A_2}{(A_2-A_1)}\cdot Ps+\frac{F}{(A_1-A_2)} \quad (2)$$

The above equation shows that the pressure Pc in the crank chamber changes in accordance with the change of pressure Ps in the suction chamber.

Figure 5:
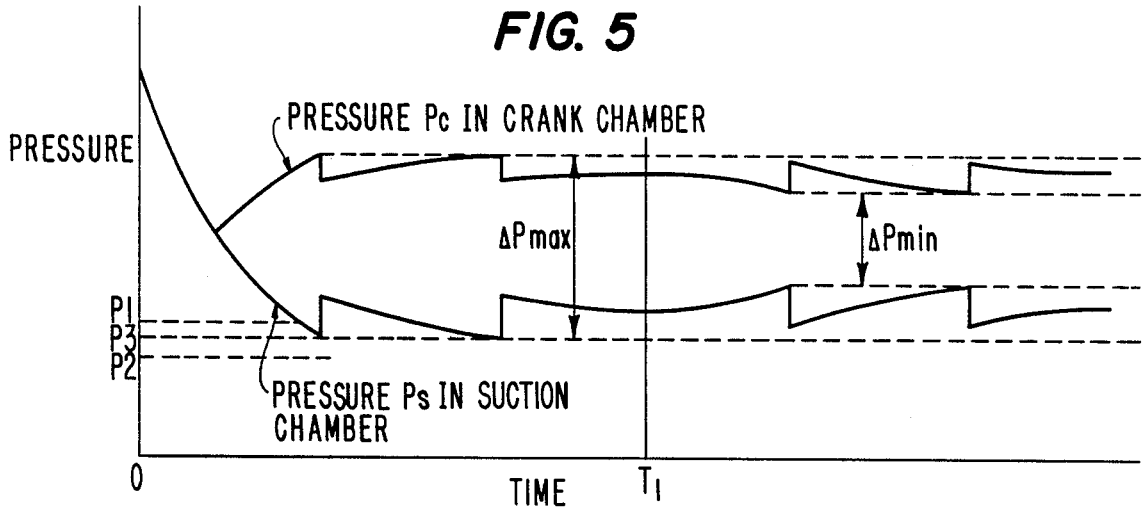
FIG. 5 is a graph illustrating the relationship between time and the pressures in the crank chamber and the suction chamber of a slant plate type compressor with a variable displacement mechanism in accordance with one embodiment of this invention.

As shown in FIG. 5, when the compressor begins operation, the pressure Ps in suction chamber 40 annd the pressure Pc in crank chamber 22 are greater than the recoil strength of coil spring 172*c* and the stiffness of bellows element 172*b*; the prssures Ps, Pc are greater than the operating point of bellows 172. Therefore, operating valve 173*a* is urged toward the left to permit communication between suction chamber 40 and th einterior of casign 171 through depressed portion 173*d* and the hole 173*e* and thereby to establish communication between crank chamber 22 and suction chamber 40 and increase the capacity of the compressor. Valve control mechanism 17 controls the communication between crank chamber 22 and suction chamber 40 so that the total pressure from crank chamber 22 and suction chamber 40 equals the total pressure provided by valve control mechanism 17. As graphically shown, the maximum and minimum differences between the crank chamber pressure Pc and the suction pressure Ps for the improved compressor of the present invention are the same as those for prior art compressors. This is because identical compressors—except for the variable displacement mechanism—are illustrated.

If the pressure Pc in crank chamber 22 and pressure Ps in suction chamber 40 is less than the operating point of bellows 172, bellows element 172*b* extends toward the right together with operating valve 173*a*. Therefore, the end opening of depressed portion 173*d* is closed by operating valve 173*a*, and there is no communication between crank chamber 22 and suction chamber 40. A tthat time, the incline angle of inclined plate 10 is maintained at the same angle. Pressure Ps in suction chamber 40 decreases in inverse proportion to the increase of pressure Pc in crank chamber 22 until suction pressure Ps reaches the predetermined pressure P3, which s selected to be between pressures P1 and P2, as shown in FIG. 5. After the end opening of depressed portion 173*d* is closed by operating valve 173*a*, the opening and closing of operating valve 173*a* is controlled by valve control mechanism 17 to satisfy equation (1). That is, when operating valve 173 obstructs communication between crank chamber 22 and suction chamber 40 through the interior of casing 171, depressed portion 173*d*, and hole 13*e*, the prssure Pc in crank chamber 22 increases as the pressure Ps in suction chamber 40 decreases. In other words, pressure Pc in crank chamber 22 changes in accordance with pressure Ps in suction chamber 40 and the pressure ratio Pc/Ps is a function of the area ratio A2/(A2-A1). The opening and closing of the end opening of depressed portion 173*d* repeats in accordance with the pressures Pc, Ps in the crank and suction chambers.

Figure 6:
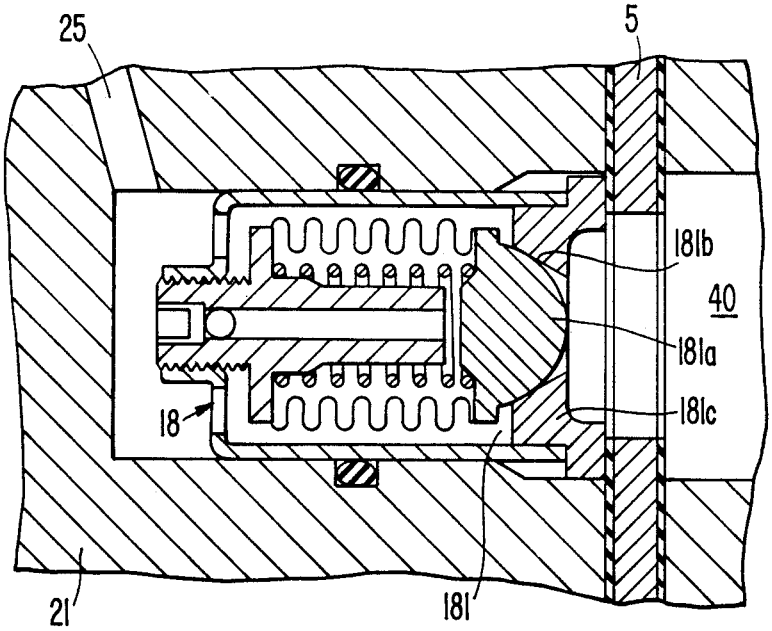
FIG. 6 is an enlarged cross-sectinal view of a variable displacement mechanism in accordance with another embodiment of this invention.
Figure 3:
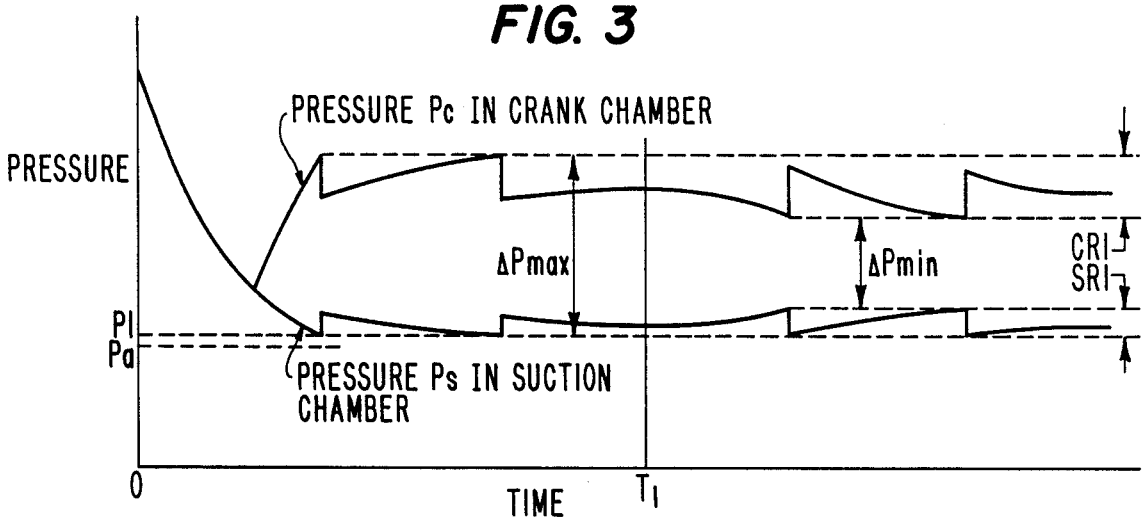
FIG. 3 is a graph illustrating the relationship between time and the pressures in the crank chamber and the suction chamber of a slant plate type compressor with a conventional variable displacement mechanism which uniformly maintains the pressure in the suction chamber.
Figure 4:
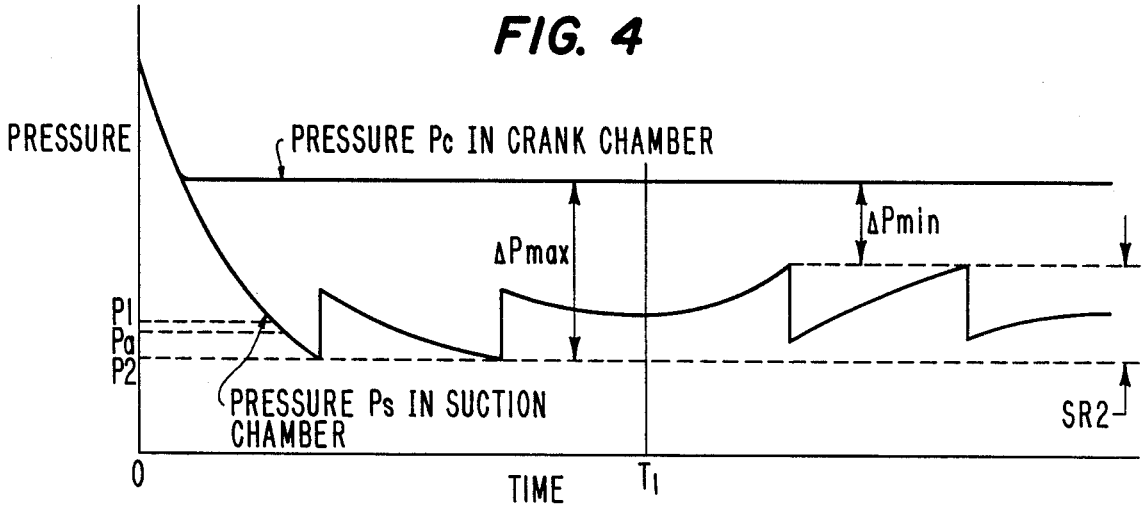
FIG. 4 is a graph illustrating the relationship between time and the pressures in the crank chamber and the suction chamber of a slant plate type compressor with another variable displacement mechanism which uniformly maintains the pressure in the crank chamber.

With reference to FIG. 6, valve control mechanims 18 in accordance with another embodiment of this invention is shown. Operating valve 181*a* of valve element 181 is spherical and the inner surface of opening 181*b* of valve seat 181*c* is complementarily cupshaped to fit with the spherical outer surface of operating valve 181*a*. The sealing between operating valve 181*a* and opening 181*b* is improved. The remaining elements of valve control mechanism 18 are essentially the same as corresponding elements of valve control mechanism 17.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

We claim:

1. In a slant plate type refrigerant compressor for use in a refrigeration circuit, said compressor including a compressor housing having a central portion, a front end plate at one end and a rear end plate at its other end, said housing having a cylinder block provided with a plurality of cylinders and a crank chamber adjacent said cylinder block, a piston slidably fitted within each of said cylinders, a drive mechanism coupled to said pistons to reciprocate said pistons within said cylinders, said drive mechanism including a drive shaft rotatably supported in said housing, a rotor coupled to said drive shaft and rotatable therewith, and coupling means for drivingly coupling said rotor to said pistons such that the rotary motion of said rotor is converted into reciprocating motion of said pistons, said coupling means including a member having a surface disposed at an inclined angle relative to said drive shaft, the inclined angle of said member being adjustable to vary the stroke length of said pistons and the capacity of said compressor, said rear end plate having a suciton chamber and a discharge chamber, a passageway connected between said crank chamber and said suction chamber, and valve means for controlling the opening and closing of said passageway to vary the capacity of the compressor by adjusting the inclined angle, the improvement comprising:

said valve means comprisign a first control valve including a bellows disposed in said passageway and responsive to the crank chamber pressure, and a second control valve including an operating valve disposed on one end surface of said bellows and a valve seat including an opening adjacent said operating valve disposed in said passageawy, said second control valve further including a depressed portion formed in said valve seat adjacent said operating valve, and a hole formed through said valve seat linking said suction chamber to said depressed portion, said depressed portion defining a suction prssure acting area foor said operating valve, said operating valve responsive to the suction chamber pressure at said suction pressure acting area, wherein said valve means opens said passageay when the combined total pressure of said crank chamber and said suction chamber exceeds a predetermined pressure and said valve means closes said passageway when the predetermined pressure exceeds the combined total pressure of said crank chamber and said suction chamber.

2. The refrigerantn compressor of claim 1 wherein said passageway is formed within said cylinder block.

3. The refrigerant compressor of claim 1 wherein said bellows has an interior maintained as a vacuum.

4. The refrigerant compressor of claim 1 wherein said operating valve is spherically shaped and said opening of said valve seat is complementarily cup-shaped.

5. The compressoor of claim 1, said passageway including a hollow portion and a conduit in said cylinder block, said bellows disposed in said hollow portion and said conduit linking said hollow portion to said crank chamber to maintain said crank chamber and said hollow portion at essentially the same pressure.

6. The compressor of claim 1, said valve seat disposed adjacent said suction chamber.

7. The compressor of claim 5, said valve seat disposed adjacent said suction chamber.

8. The compressor of claim 9, said bellows having an effective cross sectional area "$A_1$" and a reaction force "F", said depressed portion having an effective cross-sectional area "$A_2$", wherein, the crank chamber pressure $P_c$ is related to the suction chamber presure $P_s$ by the following equation:

$$P_c = \frac{A_2}{(A_2 - A_1)} \cdot P_s + \frac{F}{(A_1 - A_2)}$$

* * * * *